US010539300B2

(12) United States Patent
Kim et al.

(10) Patent No.: US 10,539,300 B2
(45) Date of Patent: Jan. 21, 2020

(54) LIGHTING APPARATUS

(71) Applicant: LG INNOTEK CO., LTD., Seoul (KR)

(72) Inventors: Ki Hyun Kim, Seoul (KR); Hwa Young Kim, Seoul (KR); Chang Hyuk Im, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 155 days.

(21) Appl. No.: 15/580,574

(22) PCT Filed: Jun. 8, 2016

(86) PCT No.: PCT/KR2016/006075
§ 371 (c)(1),
(2) Date: Dec. 7, 2017

(87) PCT Pub. No.: WO2016/200151
PCT Pub. Date: Dec. 15, 2016

(65) Prior Publication Data

US 2018/0163947 A1 Jun. 14, 2018

(30) Foreign Application Priority Data

Jun. 9, 2015 (KR) ..... 10-2015-0081380

(51) Int. Cl.
*F21V 13/02* (2006.01)
*F21V 15/01* (2006.01)
(Continued)

(52) U.S. Cl.
CPC ..... *F21V 13/02* (2013.01); *F21K 9/62* (2016.08); *F21V 7/0008* (2013.01);
(Continued)

(58) Field of Classification Search
None
See application file for complete search history.

(56) References Cited

U.S. PATENT DOCUMENTS 8,376,578 B2 * 2/2013 Kong ..... F21V 23/06 362/249.02
8,752,976 B2 * 6/2014 Pickard ..... F21V 7/22 362/147
(Continued)

FOREIGN PATENT DOCUMENTS

KR 10-2009-0053728 5/2009
KR 10-2011-0066802 6/2011
(Continued)

OTHER PUBLICATIONS

International Search Report (with English Translation) and Written Opinion dated Sep. 12, 2016 issued in Application No. PCT/KR2016/006075.

*Primary Examiner* — Britt D Hanley
(74) *Attorney, Agent, or Firm* — KED & Associates, LLP

(57) ABSTRACT

The lighting apparatus according to an embodiment includes: a housing including first and second back covers each having an inside surface in a parabola shape; a recess opened at a lower portion of the first and second back covers; a light-transmissive sheet arranged obliquely in a recess of the first and second back covers; a light emitting module between the recesses of the first and second back covers; a heat dissipation body in which the light emitting module is disposed; and a first reflective sheet for reflecting light on an inside surface of the first and second back covers, wherein the heat dissipation body includes a heat dissipation portion in which the first and second light emitting modules are disposed and a reflecting portion disposed between the heat dissipation portion and a lower end portion of the light-transmissive sheet, and the first reflective sheet has a plurality of reflective surfaces.

18 Claims, 17 Drawing Sheets

(51) Int. Cl.

| | |
|---|---|
| ***F21V 29/70*** | (2015.01) |
| ***F21V 7/04*** | (2006.01) |
| ***F21V 7/22*** | (2018.01) |
| ***F21K 9/62*** | (2016.01) |
| ***F21V 7/00*** | (2006.01) |
| ***F21Y 115/10*** | (2016.01) |
| ***F21V 7/06*** | (2006.01) |

(52) U.S. Cl.

CPC ..... *F21V 7/0033* (2013.01); *F21V 7/0066* (2013.01); *F21V 7/04* (2013.01); *F21V 7/048* (2013.01); *F21V 7/22* (2013.01); *F21V 15/01* (2013.01); *F21V 29/70* (2015.01); *F21V 7/06* (2013.01); *F21Y 2115/10* (2016.08)

(56) References Cited

U.S. PATENT DOCUMENTS

| | | | | |
|---|---|---|---|---|
| 8,905,575 | B2 * | 12/2014 | Durkee | F21V 7/0008 362/218 |
| 8,931,929 | B2 * | 1/2015 | Tarsa | H01L 33/54 362/235 |
| 9,127,826 | B2 * | 9/2015 | Boyer | F21V 7/0008 |
| 9,335,041 | B2 * | 5/2016 | Marquardt | F21V 33/006 |
| 9,494,294 | B2 * | 11/2016 | Edmond | F21V 29/006 |
| 10,001,596 | B2 * | 6/2018 | Jang | G02B 6/0016 |
| 2004/0001344 | A1 * | 1/2004 | Hecht | F21V 7/005 362/555 |
| 2009/0135587 | A1 | 5/2009 | Oketani et al. | |
| 2011/0043132 | A1 * | 2/2011 | Kim | F21S 8/026 315/294 |
| 2011/0164417 | A1 * | 7/2011 | Huang | F21V 7/0008 362/235 |
| 2012/0051041 | A1 * | 3/2012 | Edmond | F21S 8/026 362/231 |
| 2014/0268692 | A1 * | 9/2014 | Edmond | F21V 13/04 362/145 |
| 2015/0138829 | A1 | 5/2015 | Jang | |
| 2015/0177439 | A1 * | 6/2015 | Durkee | G02B 6/0021 362/555 |

FOREIGN PATENT DOCUMENTS

| | | |
|---|---|---|
| KR | 10-2011-0130222 | 12/2011 |
| KR | 10-1099379 | 12/2011 |
| KR | 10-1185533 | 9/2012 |
| KR | 10-1273363 | 6/2013 |
| KR | 10-2013-0126009 | 11/2013 |
| WO | WO 2015/076625 | 5/2015 |

* cited by examiner

LIGHTING APPARATUS

CROSS-REFERENCE TO RELATED PATENT APPLICATIONS

This application is a U.S. National Stage Application under 35 U.S.C. § 371 of PCT Application No. PCT/KR2016/006075, filed Jun. 8, 2016, which claims priority to Korean Patent Application No. 10-2015-0081380, filed Jun. 9, 2015, whose entire disclosures are hereby incorporated by reference.

TECHNICAL FIELD

An embodiment relates to a lighting apparatus.

BACKGROUND ART

In general, a lighting apparatus using a LED generates a high temperature when the LED turns on. This heat results in reduction in the life of a lamp and various components supporting the lamp thereof.

When a lighting apparatus using an LED is used, a problem of hot spot may occur. The need for lighting structures to reduce such a hotspot problem and prevent glare is growing.

DISCLOSURE

Technical Problem

An embodiment provides a lighting apparatus for a flat panel.

An embodiment provides a lighting apparatus having a light emitting diode (LED).

An embodiment provides a lighting apparatus for preventing glare.

An embodiment provides a lighting apparatus that reflects opposite side light of a plurality of LEDs to a light-transmissive sheet.

An embodiment provides a lighting apparatus that uniformly irradiates side light emitted from a LED with specular reflection and scattered reflection to a light-transmissive sheet.

Technical Solution

A lighting apparatus disclosed in an embodiment includes: a housing having a first back cover including a recess at lower portion and a reflective surface of a parabolic shape; a first light emitting module disposed on one side of the recess of the back cover and having a plurality of light emitting diodes (LEDs); a light-transmissive sheet disposed obliquely with respect to an optical axis vertical to the top surface of the light emitting diode at a recess of the housing and transmitting light emitted from the light emitting diode, wherein the reflective surface includes a first reflection region adjacent to the LEDs and a second reflection region disposed between an upper portion of the light-transmissive sheet and the first reflection region, wherein the first reflection region reflects light incident from the LED to a different region of the second reflection region, and the second reflection region reflects irregularly light incident from the first reflection region to a center region of the light-transmissive sheet.

According to an embodiment, a lighting apparatus includes: a housing including first and second back covers disposed on opposite sides of a center and each having an inside surface in a parabola shape; an recess opened at lower portions of the first and second back covers; a first light-transmissive sheet disposed obliquely in a recess of the first back cover; a second light-transmissive sheet disposed obliquely in a recess of the second back cover; a first light emitting module having a plurality of LEDs inside the recess of the first back cover; a second light emitting module having a plurality of LEDs inside the recess of the second back cover; a heat dissipation body in which the first and second light emitting modules are disposed in a region between the recess of the first back cover and the recess of the second back cover; and a first reflective sheet disposed adjacent to the LED in the inside surfaces of the first and second back covers, and reflecting first side light emitted from the plurality of LEDs, wherein the heat dissipation body includes a first heat dissipation portion in which the first light emitting module is disposed, a second heat dissipation portion in which the second light emitting module is disposed, a first reflecting portion disposed between the first heat dissipation portion and a lower end of the first light-transmissive sheet, and a second reflecting portion disposed between the second heat dissipation portion and a lower end of the second light-transmissive sheet, wherein the first reflective sheet has a plurality of reflective surfaces.

Advantageous Effects

An embodiment may provide a lighting apparatus for new flat panel.

An embodiment may improve uniformity of light in a lighting apparatus and improve glare.

An embodiment may reflect side light of a plurality of light emitting diodes (LEDs) and may provide an improving effect of glare on a light-transmissive sheet.

An embodiment may improve reliability of a lighting apparatus.

MODES OF THE INVENTION

Hereinafter, preferred embodiments of a lighting module or a lighting apparatus having a heat dissipation structure according to an embodiment will be described with reference to accompanying drawings. Terms described below are terms defined in consideration of functions in the embodiments and may vary depending on the intention of a user or operator or a practice. Therefore, such terms should be defined on the basis of the entire contents disclosed herein. In addition, the following examples propose rather than limit the scope of the present invention, and various embodiments may be implemented through the present invention.

Hereinafter, preferred embodiments of the present invention will be described in detail with reference to accompanying drawings. Meanwhile, it will be clarified in advance that the term "lighting module or lighting apparatus" as used herein collectively refers to a lighting apparatus used for indoor or outdoor use, such as a flat panel light, a luminaire, a streetlight, various lamps, an electric signboard, a headlight, or the like.

Figure 1:
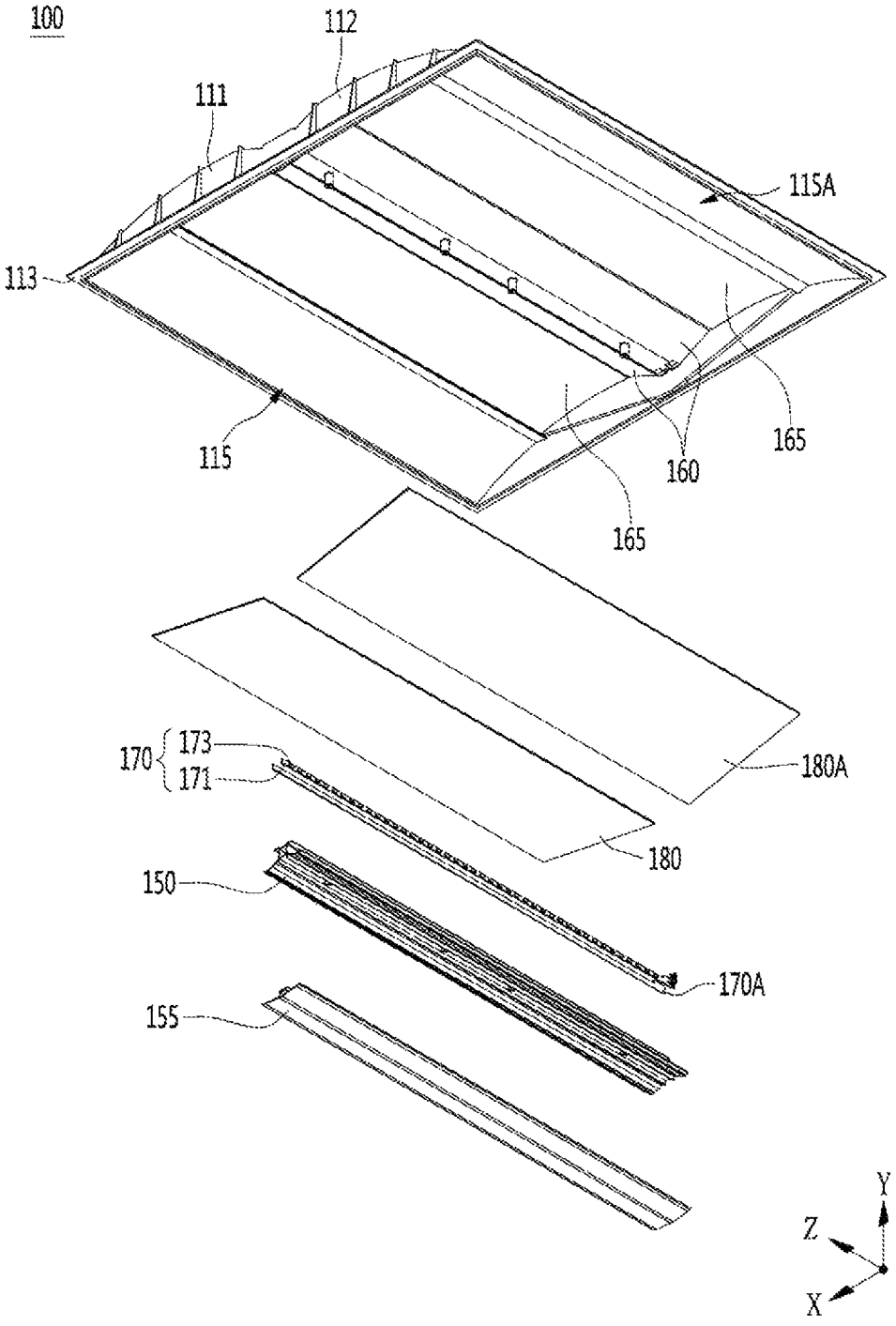
FIG. 1 is an exploded perspective view of a lighting apparatus according to an embodiment.
Figure 2:
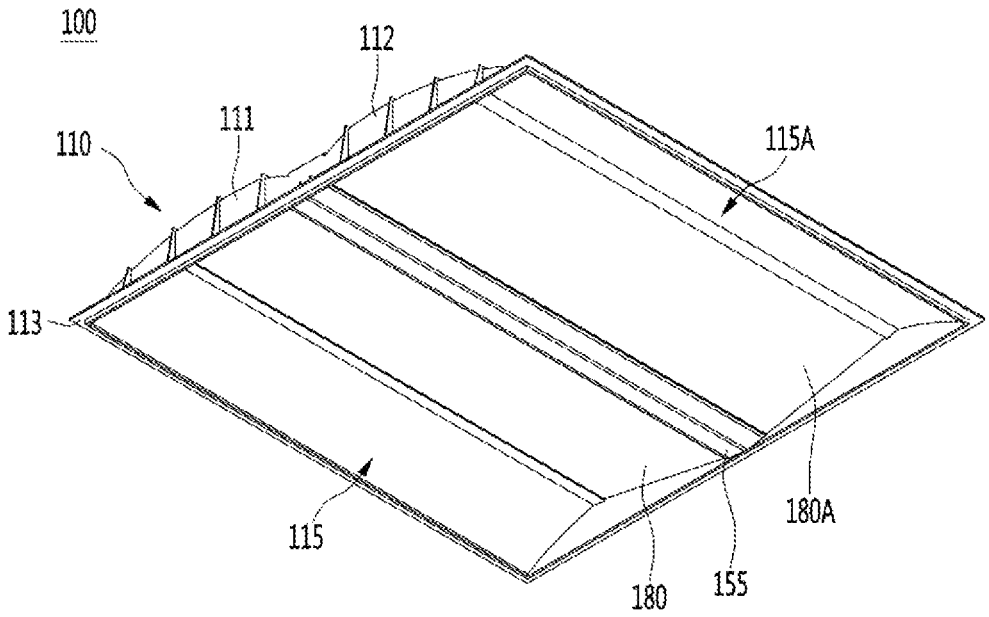
FIG. 2 is an assembled perspective view of the lighting apparatus of FIG. 1.
Figure 3:
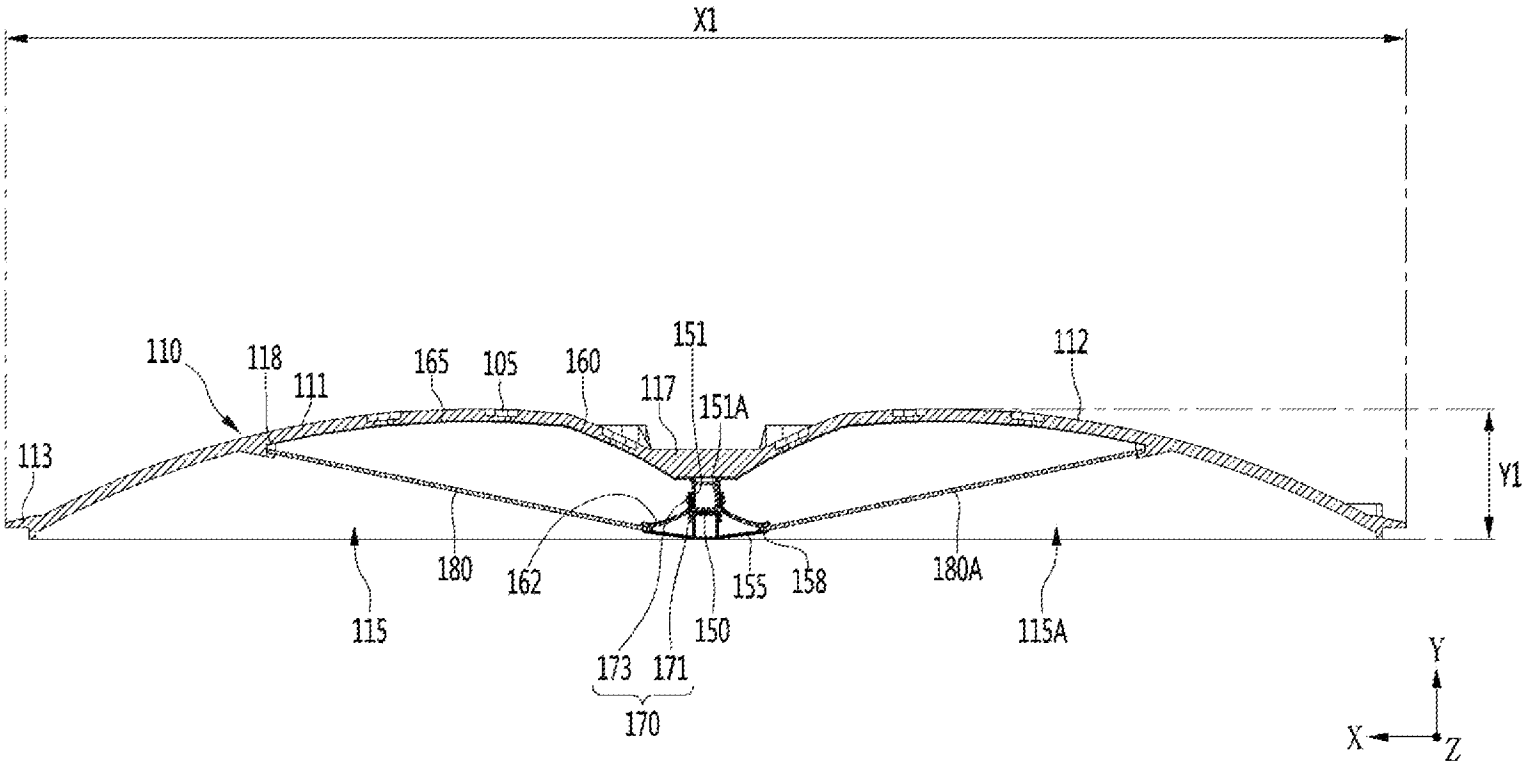
FIG. 3 is a side cross-sectional view of the lighting apparatus of FIG. 2.
Figure 4:
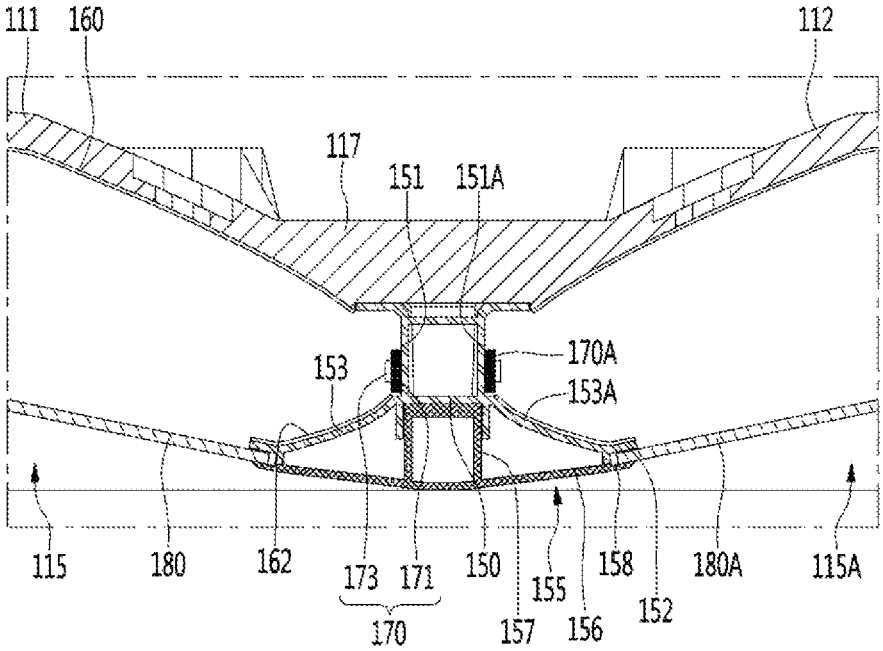
FIG. 4 is a partial enlarged view of the lighting apparatus of FIG. 2.
Figure 5:
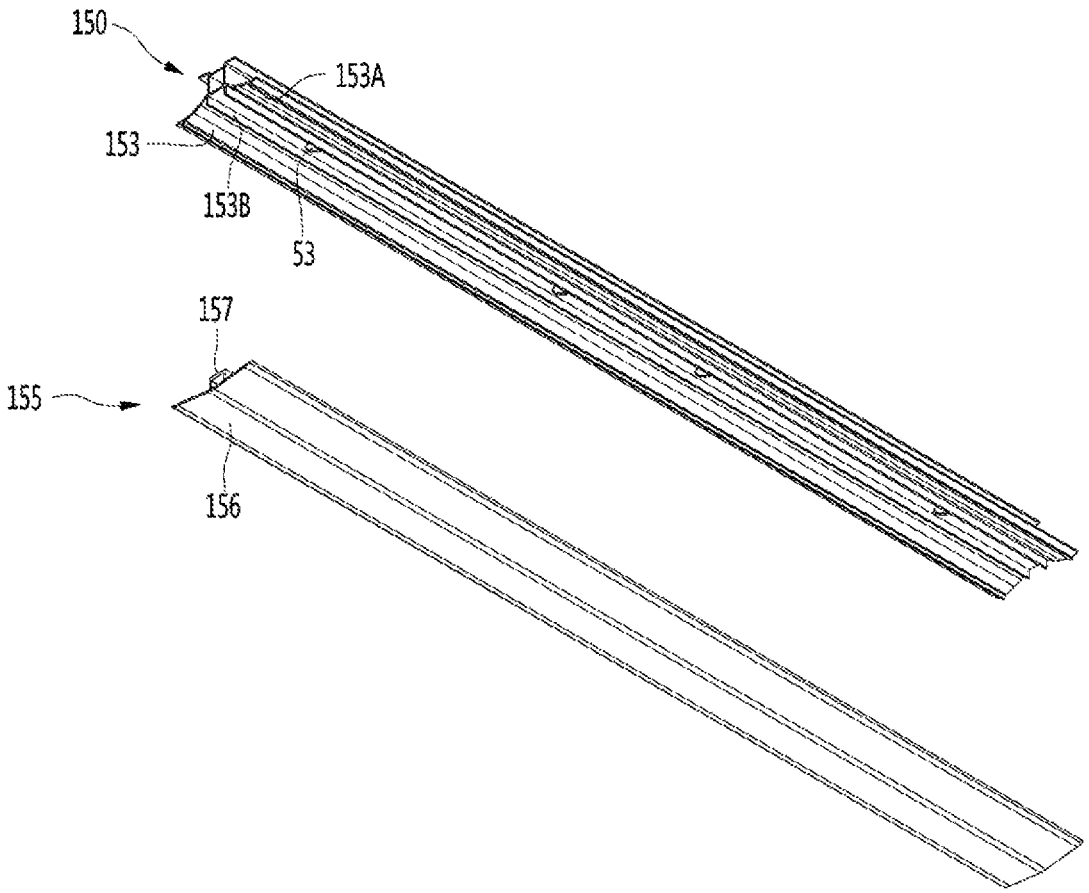
FIG. 5 is an exploded perspective view of a heat dissipation body and a heat dissipation cover of FIG. 1.
Figure 6:
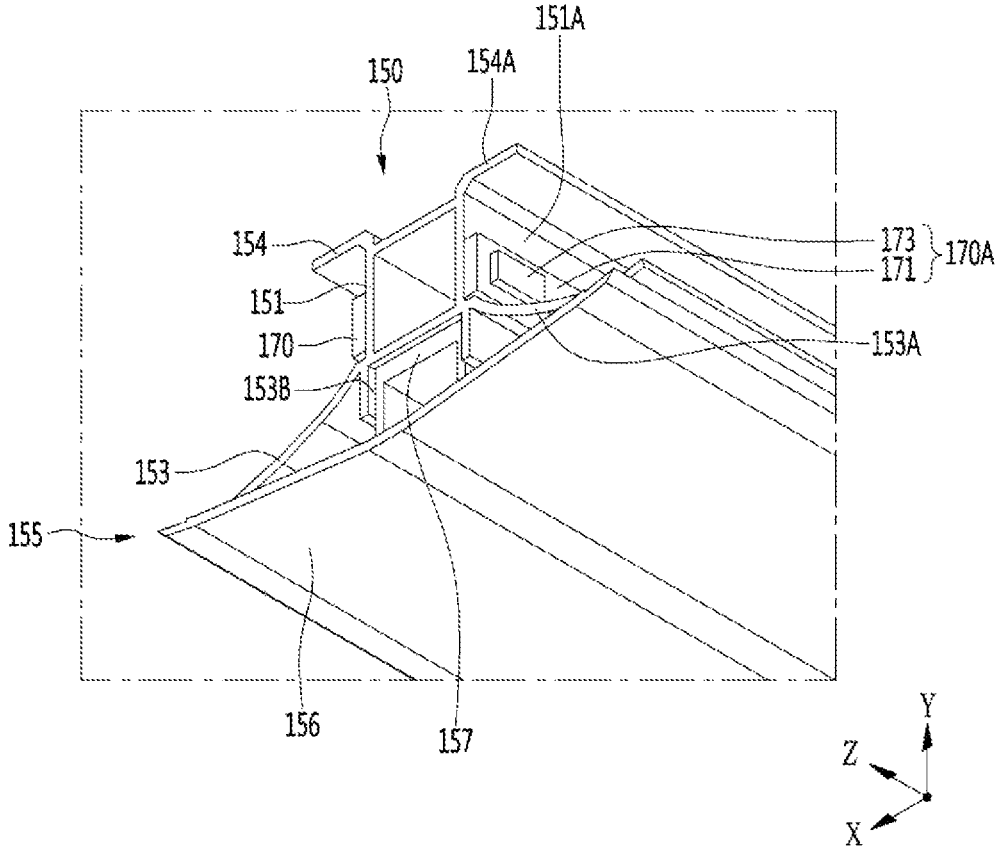
FIG. 6 is an assembled perspective view of the heat dissipation body and the heat dissipation cover of FIG. 5.
Figure 7:
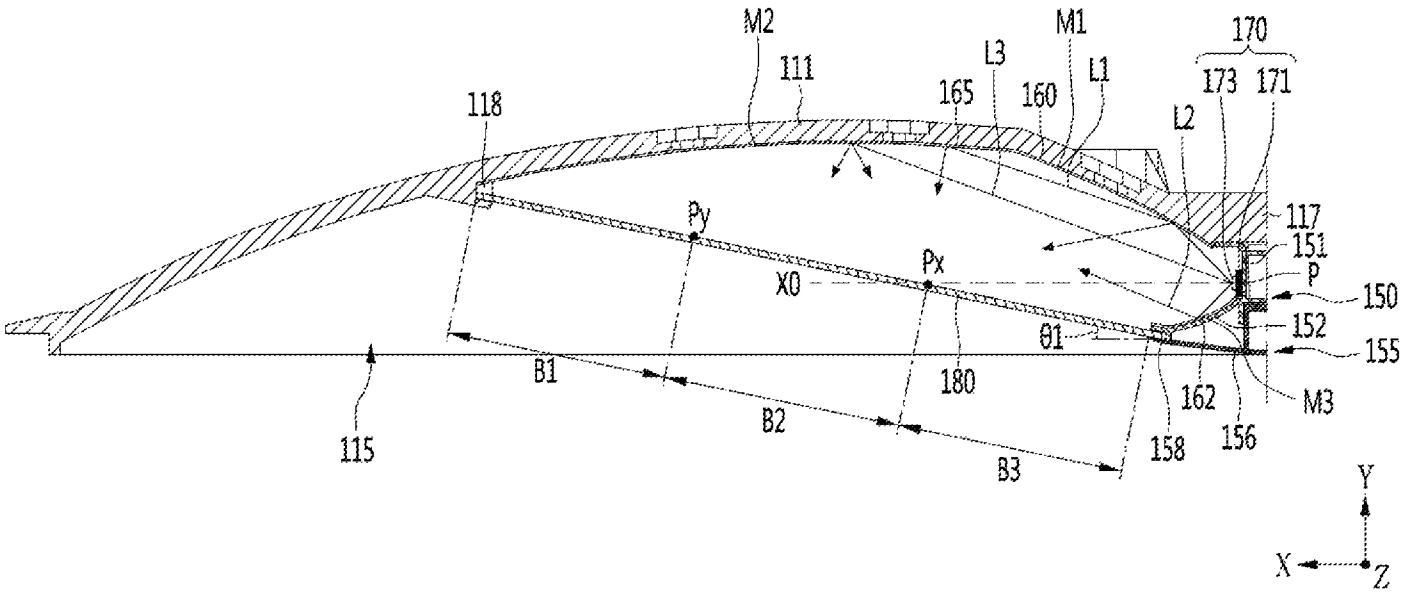
FIG. 7 is an enlarged view of a first back cover of the lighting apparatus of FIG. 3.

FIG. 1 is an exploded perspective view of a lighting apparatus according to an embodiment, FIG. 2 is an assembled perspective view of the lighting apparatus of FIG. 1, FIG. 3 is a side cross-sectional view of the lighting apparatus of FIG. 2, FIG. 4 is a partial enlarged view of the lighting apparatus of FIG. 2, FIG. 5 is an exploded perspective view of a heat dissipation body and a heat dissipation cover of FIG. 1, FIG. 6 is an assembled perspective view of the heat dissipation body and the heat dissipation cover of FIG. 5, and FIG. 7 is an enlarged view of a first back cover of the lighting apparatus of FIG. 3.

Referring to FIGS. 1 to 7, a lighting apparatus 100 includes a housing 110 having one or more back covers 111 and 112, recesses 115 and 115A at lower portions of the back covers 111 and 112, a heat dissipation body 150 disposed on one side of the lower portion of the one or more back covers 111 and 112, light emitting modules 170 and 170A disposed on the heat dissipation body 150, and light-transmissive sheets 180 and 180A disposed in the recesses 115 and 115A under the back covers 111 and 112.

The housing 110 may include back covers 111 and 112 having recesses 115 and 115A, which are recessed convexly at a lower portion, and the back covers 111 and 112 may be disposed in at least one or plural in the housing 110. The back covers 111 and 112 may be disposed in at least one in the housing 110. In this case, the heat dissipation body 150 and the light emitting modules 170 and 170A may be disposed on one side of the back covers 111 and 112. For convenience of description, an embodiment will be described with reference to a housing 110 having a plurality of back covers 111 and 112. For example, the back covers 111 and 112 may include first and second back covers 111 and 112 symmetrical to each other with respect to a centerline. Here, the centerline may be a straight line extending from a center of a first axial direction X to a second axial direction Z at the bottom of the housing 110.

An inside surface of each of the back covers 111 and 112 may include a parabola shape or an ellipse shape. An outer shape of the first and second back covers 111 and 112 may include a plurality of parabola shapes, a plurality of ellipse shapes, a hyperbola, or a pair of curved surfaces, and the present invention is not limited thereto.

A reflective member may be disposed on at least a part of the inside surfaces of the back covers 111 and 112. The reflective member may include at least one of reflective sheets 160 and 165. A first reflective sheet 160 adjacent to the light emitting modules 170 and 170A of the reflective sheets 160 and 165 and a second reflective sheet 165 disposed outside the first reflective sheet 160 may be disposed. At least one of the first and second reflective sheets 160 and 165 may not be formed. For example, the second reflective sheet 165 may not be formed. The first reflective sheet 160 may reflect incident light specularly, and the second reflective sheet 165 may reflect incident light irregularly. When the back covers 111 and 112 are formed of a material that reflects irregularly, the second reflective sheet 165 may be removed. The first and second reflective sheets 160 and 165 may be disposed overlapped vertically with the light-transmissive sheets 180 and 180A disposed on the recesses 115 and 115A. The first reflective sheet 160 may have a convex curved surface and the second reflective sheet 165 or an inside surface may have a convex curved surface.

The first and second back covers 111 and 112 may be linearly symmetrical with respect to a centerline or the heat dissipation body 150. A power supply apparatus (not shown) may be provided on the back covers 111 and 112, and is not limited thereto.

The recesses 115 and 115A are disposed under each of the first and second back covers 111 and 112, respectively. The recesses 115 and 115A are opened in a downward direction and have opposite sidewalls in the second axial direction Z.

As shown in FIG. 3, a length X1 in the first axial direction X and a length in the second axial direction Z may be the same or different in the back covers 111 and 112. A thickness Y1 or a height of the housing 110 or the back covers 111 and 112 may be 1/10 or less of the length X1 in the first axial direction X and/or the length in the second axial direction Z, and may range, for example, from 49 to 59 mm. The thickness Y1 of the back covers 111 and 112 may be disposed in 1/10 or less of the length in the first axial direction X and/or the second axial direction Z, and thus it is possible to provide a lighting apparatus having a slim thickness. The first axial direction X is a transverse direction or a width direction of the housing 110, and the second axial direction Z may be a vertical direction or a longitudinal direction as an axial direction perpendicular to the first axial direction X. In addition, the third axial direction Y may be the height direction.

A latching protrusion 113 may be disposed on an outer periphery of the housing 110, and the latching protrusion 113 may be coupled to another structure, for example, a ceiling. The latching protrusion 113 may be disposed in a stepped structure from an outer bottom of the housing 110. The latching protrusion 113 may be disposed on an outer periphery of the outer bottom of the housing 110 and may be disposed at higher than the bottom of the housing 110. The latching protrusion 113 may be disposed along the outer periphery of the housing 110, or may be disposed on opposite outer sides of the housing 110.

The back covers 111 and 112 of the housing 110 may include at least one of plastic materials such as polycarbonate (PC), polyethylene terephthalate glycol (PETG), polyethylene (PE), polystyrene paper (PSP), polypropylene (PP), and polyvinyl chloride (PVC).

The back covers 111 and 112 may be a material having a higher reflectance than a transmittance, and material having a reflectance of 70% or more, for example, 80% or more. The back covers 111 and 112 may have higher reflectance, and thus light incident on surfaces of the back covers 111 and 112 can be reflected. The back covers 111 and 112 may be a material having a light absorption rate of 20% or less, for example, 15% or less, and is not limited thereto. The first and second back covers 111 and 112 of the housing 110 may be formed of a white material.

As shown in FIG. 3, a fastening hole 105 for fastening to other structures may be disposed in the back covers 111 and 112. The fastening hole 105 may be disposed in an upper portion region of the outer side surfaces of the first and second back covers 111 and 112. A region between the first and second back covers 111 and 112 is formed as a concave connection part 117 which is lower than the outer side surfaces of the first and second back covers 111 and 112, and the connection part 117 may be a boundary portion between the first and second back covers 111 and 112. The connection part 117 has a thickness greater than that of a material of the first and second back covers 111 and 112, and supports a center region of the housing 110. The connection part 117 may be disposed in a concave region, and thus components such as a power supply apparatus can be disposed on the connection part 117. The back covers 111 and 112 have symmetrical shapes, and thus for convenience of description, one back cover will be described as a reference.

The heat dissipation body 150 may be disposed under one side region of the back cover 111. The heat dissipation body 150 may be disposed under one region of the first back cover 111. The heat dissipation body 150 may be disposed under a center region of the first and second back covers 111 and 112. The heat dissipation body 150 may be disposed in a region between the first recess 115 of the first back cover 111 and the second recess 115A of the second back cover 112. The heat dissipation body 150 may be disposed long along the connection part 117 under the connection part 117 of the housing 110. A groove 117A may be disposed in a lower portion of the connection part 117, and the groove 117A may be formed in an upward concave shape at the lower portion of the connection part 117.

The heat dissipation body 150 may be formed of a metal material and may include at least one of metals such as aluminum, copper, nickel, and silver, and is not limited thereto. The heat dissipation body 150 may include a carbon substance, and is not limited thereto.

A plurality of light emitting modules 170 and 170A may be disposed on the heat dissipation body 150. The heat dissipation body 150 supports the plurality of light emitting modules 170 and 170A and dissipates heat generated from the plurality of light emitting modules 170 and 170A. The heat dissipation body 150 may be disposed between the connection part 117 of the housing 110 and a heat dissipation cover 155. The heat dissipation body 150 and the heat dissipation cover 155 may be fastened to the connection part 117 of the housing 110.

The plurality of light emitting modules 170 and 170A may be located on the opposite sides of the heat dissipation body 150. The plurality of light emitting modules 170 and 170A may be disposed inside the recesses 115 and 115A at opposite sides. The heat dissipation body 150 may be formed in a symmetrical shape with respect to a centerline, and is not limited thereto. The centerline may be a line in an axial direction Y perpendicular to a center in the first axial direction X in a lighting apparatus.

As shown in FIGS. 3 to 6, the heat dissipation body 150 includes heat dissipation portions 151 and 151A and reflecting portions 153 and 153A. The heat dissipation portions 151 and 151A have a flat vertical surface and may face a predetermined region of the light-transmissive sheets 180 and 180A. The heat dissipation portions 151 and 151A may include a first heat dissipation portion 151 disposed inside the lower portion of the first back cover 111 and a second heat dissipation portion 151A disposed inside the lower portion of the second back cover 112. The first heat dissipation portion 151 may be disposed inside the first recess 115, and the second heat dissipation portion 151A may be disposed inside the second recess 115A. Here, the first and second recesses 115 and 115A may be separated from each other by the heat dissipation body 150. The first and second heat dissipation portions 151 and 151A may be disposed on the opposite sides of the heat dissipation body 150. The first heat dissipation portion 151 may be disposed parallel to the second heat dissipation portion 151A in the second axial direction Z.

The first and second heat dissipation portions 151 and 151A have flat surfaces, and the flat surfaces are disposed in a vertical plane such as the third axial direction Y and disposed at a right angle to the first axial direction X. The first and second heat dissipation portions 151 and 151A are disposed in opposite directions to each other with respect to a center of a lighting apparatus. The first and second heat dissipation portions 151 and 151A may be arranged in a direction of the different recesses 115 and 115A, for example, in a light emitting direction.

As shown in FIGS. 3, 4 and 6, light emitting modules 170 and 170A are disposed on each of the heat dissipation portions 151 and 151A, and center side main light in light emitted from the light emitting modules 170 and 170A may be radiated to the light-transmissive sheets 180 and 180A, which may be defined as direct lighting. Side sub-light in light emitted from the light emitting modules 170 and 170A may be reflected in the recesses 115 and 115A and radiated to the light-transmissive sheets 180 and 180A, which may be defined as indirect lighting. An embodiment may include indirect lighting and direct lighting, which may reduce a hot spot by direct lighting through indirect lighting.

Reflecting portions 153 and 153A may be disposed at a lower portion of the heat dissipation body 150. The reflecting portions 153 and 153A may be connected to lower portions of the heat dissipation portions 151 and 151A. The reflecting portions 153 and 153A may include a plurality of reflection regions having different radii of curvature for reflecting incident light. The reflecting portions 153 and 153A include first and second reflecting portions 153 and 153A extending from each of the heat dissipation portion 151 and 151A. The first reflecting portion 153 may extend downward from the first heat dissipation portion 151, and the second reflecting portion 153A may extend downward from the second heat dissipation portion 151A.

The first reflecting portion 153 may be disposed between the first heat dissipation portion 151 and the heat dissipation cover 155, and the second reflecting portion 153A may be disposed between the second heat dissipation portion 151A and the heat dissipation cover 155. The first reflecting portion 153 may be disposed under the first light emitting module 170, and the second reflecting portion 153A may be disposed under the second light emitting module 170A. The first and second reflecting portions 153 and 153A may have concavely curved or inclined surfaces.

The first reflecting portion 153 may be disposed between the first heat dissipation portion 151 and a lower end portion of the first light-transmissive sheet 180. The second reflecting portion 153A may be disposed between the second heat dissipation portion 151A and a lower end portion of the second light-transmissive sheet 180A. An upper surface of the first reflecting portion 153 may include a reflection region having different radii of curvature, and an upper surface of the second reflecting portion 153A may include a reflection region having different radii of curvature.

The first and second reflecting portions 153 and 153A are adjacent to the light emitting modules 170 and 170A, and reflect second side light in light emitted from a light emitting diode (LED) 173 to the light-transmissive sheets 180 and 180A and the inside surfaces of the back covers 111 and 112. A third reflective sheet 162 may be disposed on an inside surface of the reflecting portion 153 or 153A, or the reflecting portion 153 or 153A may be coated with a reflection material, or a metal surface of the heat dissipation body 150 may be exposed.

The third reflective sheet 162 may be disposed on an inside surface of the reflecting portion 153 or 153A and reflect light emitted from the LED 173.

Referring to FIGS. 4 to 6, a heat dissipation cover 155 may be disposed under the heat dissipation body 150. The heat dissipation cover 155 may include a metal material and be combined with the metal body 150, and thus heat dissipation efficiency can be improved. The heat dissipation cover 155 may be in surface contact with the heat dissipation body 150. A part of the heat dissipation cover 155 is in contact with a region between the first and second heat dissipation portions 151 and 151A, and thus conducted heat can be dissipated.

A latching groove 158 may be provided at least one of outside the heat dissipation body 150 and the heat dissipation cover 155, and lower end portions of the light-transmissive sheets 180 and 180A may be disposed in the latching groove 158.

A lower portion plate 156 of the heat dissipation cover 155 extends in a direction of the first and second recesses 115 and 115A. The lower portion plate 156 may be moved away from the center as getting away from the center, with respect to a horizontal straight line from a center. The lower portion plate 146 may have a concave curved or inclined surface with a lower center and extend to the lower end portions of the light-transmissive sheets 180 and 180A coupled to each of the recesses 115 and 115A.

As shown in FIG. 6, an upper portion 157 of the heat dissipation cover 155 may be inserted into and coupled to a receiving groove 153B of the heat dissipation body 150. The upper portion 157 of the heat dissipation cover 155 has a shape to be inserted into the receiving groove 153B, for example, a horizontal coupling portion and a vertical supporting portion, the coupling portion is coupled to the receiving groove 153B, and the vertical supporting portion is connected to the heat dissipation plate 156. Here, as shown in FIG. 5, a plurality of fastening holes 153C may be disposed inside the receiving groove 153B, and a fastening hole (not shown) corresponding to the hole 153C may be disposed on the upper portion 157 of the heat dissipation cover 155. Accordingly, the upper portion 157 of the heat dissipation cover 155 may be fastened to the heat dissipation body 150 through the fastening holes, and the heat dissipation body 150 may be fixed to the housing 110 by a coupling member such as a fastening means together with the heat dissipation cover 155. As another example, the heat dissipation cover 155 may be integrally formed with the heat dissipation body 150, and is not limited thereto.

Referring to FIG. 6, upper portions 154 and 154A of the heat dissipation body 150 may be inserted into the groove 117A of the center side connection part 117 of the back cover 111 and then fixed with a coupling member, and the coupling member may include an adhesive, fastening means, or a hook, and is not limited thereto. The fastening means may include components such as a screw or a rivet.

As shown in FIGS. 1 and 6, the light emitting modules 170 and 170A may be disposed on the heat dissipation portions 151 and 151A of the heat dissipation body 150. The light emitting modules 170 and 170A include a first light emitting module 170 disposed on the first heat dissipation portion 151 and a second light emitting module 170A disposed on the second heat dissipation portion 151A.

Each of the light emitting modules 170 and 170A includes a circuit board 171 and a plurality of LEDs 173 disposed on the circuit board 171. The circuit board 171 may stand in the third axial direction Y and may be disposed long in the second axial direction Z, and the plurality of LEDs 173 may be arranged in the second axial direction Z on the circuit board 171.

The circuit board 171 may be disposed on the heat dissipation portions 151 and 151A in a longitudinal direction (Z-axis direction) of the heat dissipation body 150. The circuit board 171 may be disposed in one or plural on the heat dissipation portions 151 and 151A, and is not limited thereto. The circuit board 171 may be attached to the heat dissipation portions 151 and 151A by screws and/or adhesives, and is not limited thereto.

The circuit board 171 may include, for example, a printed circuit board (PCB). The PCB includes at least one of a resin material PCB, a metal core PCB (MCPCB), and a flexible PCB (FPCB), and for example, may be provided as a metal core PCB for heat dissipation.

The LED 173 may be a package in which a light emitting chip is packaged and emit at least one of blue, red, green, and white lights, and UV. For example, white light may be emitted for lighting. The LED 173 may be mounted on the circuit board 171 in a chip form. In this case, the LED 173 may have an orientation angle of 115 degrees or more, for example, 118 degrees or more. In this case, the orientation angle of the LED 173 may vary depending on a structure of a package or a shape of a cavity in a package, and is not limited thereto.

The LED 173 may be arranged on the circuit board 171 in one row or two or more rows, and is not limited thereto.

According to the embodiment, the LED 173 may include, for example, a warm white LED and a cool white LED on the circuit board 171. The warm white LED and the cool white LED are an apparatus emitting white light. The warm white LED and the cool white LED may each emit a correlated color temperature and emit white light of mixed light, and thus the color rendering index (CRI) indicating a proximity to the natural sunlight becomes high. Therefore, it is possible to prevent color of an actual object from being distorted, thereby reducing the fatigue of a user's eyes.

As shown in FIGS. 3 and 4, the light-transmissive sheets 180 and 180A includes a first light-transmissive sheet 180 disposed under the first recess 115 and a second light-transmissive sheet 180A disposed under the second recess 115A. The first light-transmissive sheet 180 and the second transmitting sheet 180A are disposed obliquely, and the internal angle formed by the first light-transmissive sheet 180 and the second light-transmissive sheet 180A may be less than 180 degrees, for example, 170 degrees or less.

The light-transmissive sheets 180 and 180A may be a sheet having a diffusing agent or may include a diffusion sheet material. The light-transmissive sheets 180 and 180A may include at least one of a diffusion sheet, for example, at least one of polymethyl methacrylate (PMMA), polypropylene (PP), polyethylene (PE), and polystyrene (PS). The light-transmissive sheets 180 and 180A may be caught and fixed to the latching groove 158 of a lower end portion 152 of the heat dissipation body 150 and a latching groove 118 of the back covers 111 and 112.

Here, the light-transmissive sheet 180 may be disposed obliquely on the recesses 115 and 115A of the back covers 111 and 112. The latching groove 118 may protrude from the inside surfaces of the back covers 111 and 112.

An embodiment may remove the reflective sheet on a convex curved surface of the inside surfaces of the back covers 111 and 112. As shown in FIG. 7, when there is no reflective sheet on the inside surfaces of the back covers 111 and 112, the inside surfaces of the back covers 111 and 112 may be divided into a plurality of reflection regions M1 and M2 disposed between the LED 173 and an upper end portion of the light-transmissive sheet 180. The reflection regions M1 and M2 may include a first reflection region M1 adjacent to the LED 173 and a second reflection region M2 disposed between the first reflection region M1 and the upper end portion of the light-transmissive sheet 180.

The first reflection region M1 may reflect first side light L1 from light emitted from the LED 173 to the second reflection region M2. The second reflection region M2 may reflect main light radiated from the LED 173 and light reflected from the first reflection region M1 to the light-transmissive sheet 180. The first reflection region M1 may include a plurality of reflective surfaces having different radii of curvature or inclined surfaces. The second reflection region M2 may include a plurality of reflective surfaces having different radii of curvature or planes.

The first reflection region M1 is a specular reflecting region, and the second reflection region M2 is a scattered reflecting region for incident light L1, L2, and L3. The first reflection region M1 may be disposed in a region that is deviated from a direction of a quarter of orientation angle (angle A1, A2, and A3 in FIG. 9) with reference to an optical axis X0 of the LED 173. The first reflection region M1 may form an angle of 28 to 33 degrees with respect to opposite ends of the LED 173 and may be wider than an angle formed between opposite ends of the second reflection region M2 (A3 in FIG. 9). The second reflection region M2 may form an angle (A3 in FIG. 9) ranging from 21 to 26 degrees with respect to the opposite ends of the LED 173 and may be smaller than an angle R1+R2+R3+R4 of FIG. 9 formed by the first reflection region M1. Accordingly, the first reflection region M1 may be disposed in an angle range that allows the right side light L1 incident thereon to be reflected specularly to different region of the second reflection region M2.

A straight line perpendicular to a center P of a top surface of the LED 173 may be defined as an optical axis X0. The light-transmissive sheet 180 has a first point Px intersecting the optical axis X0, and the first point Px may be located at a point equal to or more than ½, for example, ⅔ of an upper end of the light-transmissive sheet 180. In addition, a second point Py may be ⅓ from the upper end of the light-transmissive sheet 180.

The upper end of the light-transmissive sheet 180 and the first point Px may have an angle range of less than 10 degrees with respect to the LED 173, and is not limited thereto. With respect to the center P of the top surface of the LED 173, an angle formed by opposite ends of the light-transmissive sheet 180 is greater than an angle formed by the first reflection region M1 or the second reflection region M2, and, for example, may range from 34 to 39 degrees.

A third reflection region M3 may be disposed on a region other than the back covers 111 and 112, for example, on the heat dissipation body 150 or the heat dissipation cover 155. The third reflection region M3 reflects the incident light to the second reflection region M2 or the light-transmissive sheet 180. With respect to the center P of the top surface of the LED 173, an angle formed by opposite ends of the third reflection region M3 on a lower portion may be greater than an angle formed by the first reflection region M1 or the second reflection region M2.

When the reflective sheets 160 and 165 are disposed on the inside surfaces of the back covers 111 and 112, referring to FIGS. 3 to 6, the first reflective sheet 160 may be disposed on the first reflection region M1, and the second reflective sheet 165 may be disposed on the second reflection region M2, and the third reflective sheet 162 may be disposed on the third reflection region M3.

The first reflective sheet 160 may include a material different from that of the second reflective sheet 165. The first reflective sheet 160 may include a specular reflective sheet or a mirror sheet, and the second reflective sheet 165 may include a scattered reflective sheet or a white color sheet. The first reflective sheet 160 may include materials of Ag or Al. The second reflective sheet 165 may include a white color plastic material such as polycarbonate (PC), or a nano-coated layer, or a pattern-formed metal layer or resin layer. The third reflective sheet 162 may include the same material as that of the first reflective sheet 160.

The first, second, and third reflective sheets 160, 165, and 162 may include curved surfaces having a plurality of inflection points, and the curved surfaces may reflect light to a desired optical path.

The first and second reflective sheets 160 and 165 include a material having a light reflectance of 90% or more. In addition, the first reflective sheet 160 includes a material having a reflectance higher than that of the second reflective sheet 165. Such a light reflectance may reflect light without loss of incident light, and thus a light extraction effect can be improved. The third reflective sheet 162 may be formed of the same material as that of the first reflective sheet 160, for example, a specular reflection material.

Here, at least one of the first and second reflective sheets 160 and 165 may be removed, and is not limited thereto. When the heat dissipation body 150 is a specular reflection material, the third reflective sheet 162 may be removed, and is not limited thereto.

Referring to FIG. 7, the light-transmissive sheet 180 may be disposed obliquely. The light-transmissive sheet 180 may be disposed and inclined at an angle θ1 in the range of 13 degrees or less, for example, 9 to 13 degrees, with respect to an optical axis X0. The light-transmissive sheet 180 may be disposed and inclined in the range of, for example, 11 to 12 degrees with respect to the optical axis X0. When the light-transmissive sheet 180 deviates from the angle θ1, a distribution of light reflected from the first to third reflective sheets 160, 165, and 162 may not be uniform. In addition, the light-transmissive sheet 180 may directly receive and diffuse main light emitted from the LED 173 by the inclined angle θ1.

An upper surface of the LED 173 or a rear surface of the circuit board 171 may be disposed at a right angle or in a range of 89 to 91 degrees with respect to the first horizontal axis X. Accordingly, the light emitted from the LED 173 may be directly radiated onto entire regions B1, B2, and B3 of the light-transmissive sheet 180.

When light reflected from the first and third reflective sheets 160 and 162 is reflected irregularly by the second reflective sheet 165 and is incident on the different regions B1, B2, and B3, the light-transmissive sheet 180 diffuses and transmits the incident light. Accordingly, it is possible to prevent the occurrence of a bright line in the light-transmissive sheet 180 by directly incident light and indirectly incident light, and to prevent glare.

A minimum distance between a center of the LED 173 and the first reflective sheet 160 may be in a range of 8 mm or more, for example, 9 to 11 mm. When the minimum distance between the center of the LED 173 and the first reflective sheet 160 is smaller than the above range, light deviating from the orientation angle may be incident, and thus the improvement of the reflection efficiency can be insignificant. When the minimum distance between the center of the LED 173 and the first reflective sheet 160 is greater than the above range, it is difficult to control a path through which light is reflected, and thus leakage of side light may occur.

A minimum distance between the center of the LED 173 and the third reflective sheet 162 may be in a range of 5 mm or less, for example, 4 to 4.8 mm. When such a minimum distance is smaller than the above range, the circuit board 171 may not be easily installed. When the minimum distance is greater than the above range, leakage of side light may occur.

A minimum distance between the center of the LED 173 and the light-transmissive sheet 180 may be at least two times the minimum distance between the LED and the first reflective sheet, and, for example, may range from 20 to 23 mm. When the minimum distance between the center of the LED 173 and the light-transmissive sheet 180 is greater than the above range, inclination becomes too large, and thus it is difficult to uniformly control the light distribution. When the minimum distance between the center of the LED 173 and the light-transmissive sheet 180 is smaller than the above range, hot spots or bright lines may be generated.

Figure 8:
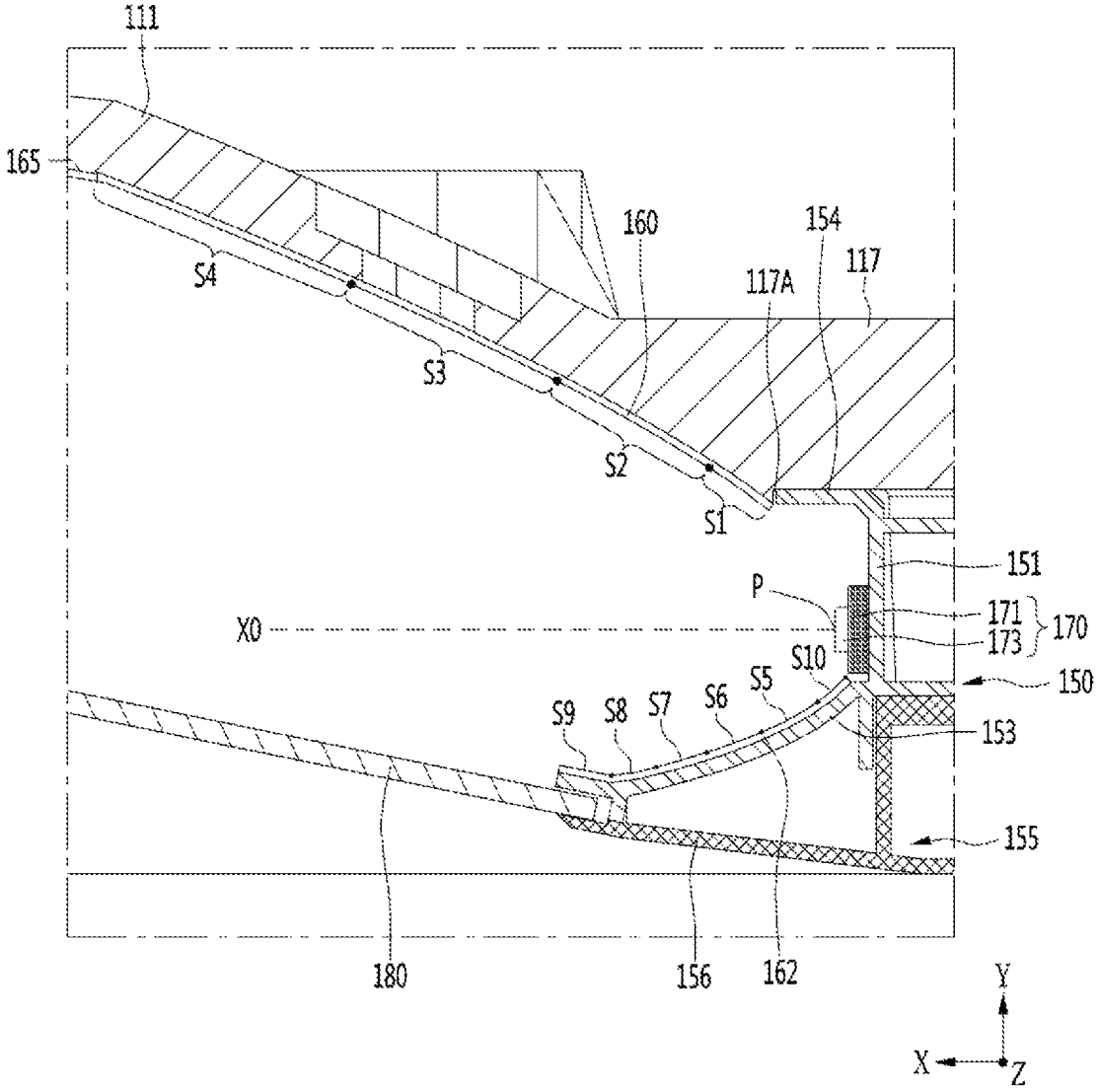
FIG. 8 is a view illustrating first and third reflective sheets on the first back cover of FIG. 7.

As shown in FIG. 8, the first reflective sheet 160 includes a large number of reflective surfaces S1, S2, S3, and S4, and the large number of reflective surfaces S1, S2, S3, S4 may include curved surfaces having positive radii of curvature. Radii of curvature of the large number of reflective surfaces S1, S2, S3, and S4 may become greater as a distance from the LED 173 increases. The large number of reflective surfaces S1, S2, S3, and S4 may be at least three, and, for example, may include three to five. When the number of the reflective surfaces S1, S2, S3, and S4 is too small, it is difficult to control dispersion of light, and when the number of the reflective surfaces S1, S2, S3, and S4 is too large, brightness of the reflected light may be deteriorated.

The large number of reflective surfaces S1, S2, S3, and S4 may include, for example, first through fourth reflective surfaces S1, S2, S3, and S4. The first reflective surface S1 has a radius of curvature in the range of 40 to 50 mm, for example, 44 to 48 mm, the second reflective surface S2 has a radius of curvature of at least two times, for example, 2.5 to 3 times the radius of curvature of the first reflective surface S1, and the third reflective surface S3 may have two times or more the radius of curvature of the second reflective surface S2 and may have 5 times or more, for example, 5.6 times to 6.1 times or less the radius of curvature of the first reflective surface S1.

The fourth reflective surface S4 may have 1.5 times or more the radius of curvature of the third reflective surface S3 and may be disposed between nine to twelve times the radius of curvature of the first reflective surface S1. The fourth reflective surface S4 may have a radius of curvature in the range of 450 mm or more, for example, 460 mm to 500 mm. The fourth reflective surface S4 may have the largest radius of curvature in the first reflective sheet 160 and may reflect the incident light to the second reflective sheet 165.

A straight line distance of opposite ends of the fourth reflective surface S4 is greater than that of opposite ends of each of the first through third reflective surfaces S1, S2, S3, and a straight line distance of opposite ends of the third reflective surface S3 may be greater that of opposite ends of the second reflective surface S2. A straight line distance of opposite ends of the second reflective surface S2 may be greater than that of opposite ends of the first reflective surface S1. As a distance from the LED 173 increases, the straight line distance of opposite ends of each of the reflective surfaces S1, S2, S3, and S4 increases gradually, and thus light may be radiated to each of regions of the second reflective sheet 165.

Figure 9:
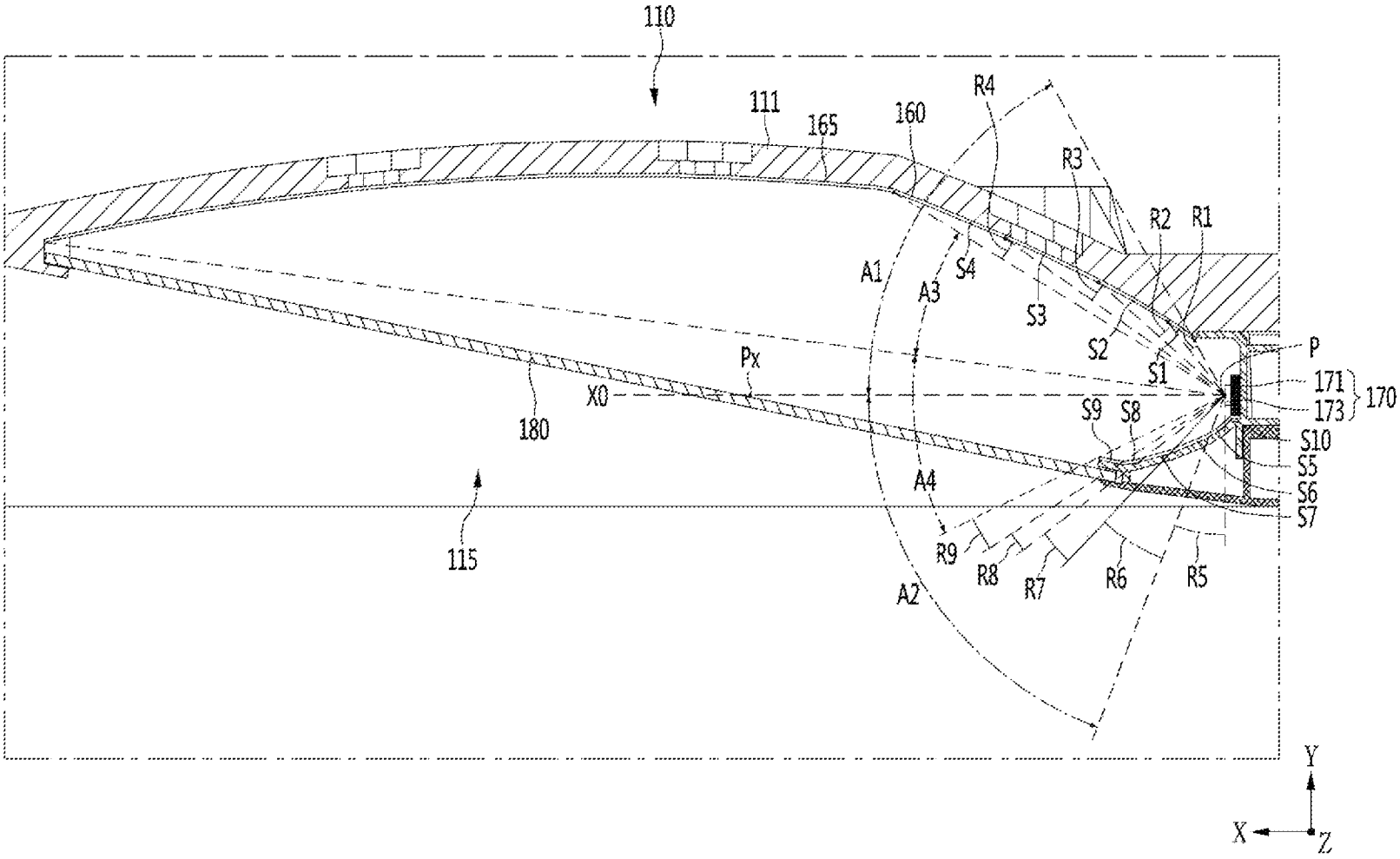
FIG. 9 is a detailed view of a region of the reflective sheet on the first back cover of FIG. 7.

Referring to FIGS. 8 and 9, when viewing an angle P formed between opposite ends of each of the first to fourth reflective surfaces S1, S2, S3, and S4 of the first reflective sheet 160 and the center of the top surface of the LED 173, an angle P (R1) of the first reflective surface S1 is in the range of 8 to 10 degrees, an angle P (R2) of the second reflective surface S2 is in the range of 9.5 to 12 degrees, an angle P (R3) of the third reflective surface S3 in the range of 5 to 7.5 degrees, an angle P (R4) of the fourth reflective surface S4 is in the range of 3 to 6 degrees.

The third reflective sheet 162 may be disposed between the lower end portion of the light-transmissive sheet 180 and the LED 173. The third reflective sheet 162 may include a large number of reflective surfaces S5, S6, S7, and S8 having different radii of curvature. The reflective surfaces S5, S6, S7, and S8 of the third reflective sheet 162 may have radii gradually increased as getting farther away from the LED 173. For example, the reflective surfaces S5, S6, S7, and S8 of the third reflective sheet 162 may include two or more, for example, three or more curved surfaces or planes. The reflective surfaces S5, S6, S7, and S8 of the third reflective sheet 162 may include fifth through eighth reflective surfaces S5, S6, S7, and S8, and the fifth reflective surface S5 may have greater than the radius of curvature of the first reflective surface S1 and, for example, may have 1.5 or more times the radius of curvature of the first reflective surface S1 in the range of 15 mm to 19 mm.

The radius of curvature of the sixth reflective surface S6 may be two times greater than that of the fifth reflective surface S5, for example, may be 2.1 to 2.5 times the radius of curvature of the fifth reflective surface S5. The seventh reflective surface S7 may have greater than the radius of curvature of the sixth reflective surface S6 and may have greater than the radius of curvature of the fifth reflective surface S5 by 3.7 times or more, for example, 3.9 to 4.3 times. The eighth reflective surface S8 may have greater than the radius of curvature of the seventh reflective surface S7, and the eighth reflective surface S8 may range from 4.2 to 4.8 times the radius of curvature of the fifth reflective surface S5, for example, 4.4 times to 4.6 times.

The third reflective sheet 162 may include a ninth reflective surface S9 having an inclined plane or a radius of curvature as an overlapping region with a lower end portion of the light-transmissive sheet 180, and light incident on the ninth reflective surface S9 may be reflected irregularly by the second reflective sheet 165.

The third reflective sheet 162 may include a tenth reflective surface S10 adjacent to the LED 173 rather than the sixth reflective surface S6, and the tenth reflective surface S10 may be a curved surface or a planar surface and may reflect light deviating from the orientation angle of the LED 173.

Referring to FIGS. 8 and 9, when viewing an angle of the triangle connected at opposite ends of each of the reflective surfaces S5, S6, S7, S8, and S9 of the third reflective sheet 162 and the center P of the LED 173, an angle P (R5) of the fifth reflective surface S5 is a region deviated from an orientation angle and may be reflected by the second reflective sheet 165 with respect to light deviating from the orientation angle.

Angles P (R6, R7, R8, and R9) of the sixth reflective surface S6 to the eighth reflective surface S8 may become smaller as a distance from the LED 173 increases. For example, at an angle P of the sixth reflective surface S6 to the eighth reflective surface S8, the angle P (R8) of the eighth reflective surface S8 may be the smallest, and the angle P (R6) of the sixth reflective surface S6 may be the largest.

The angle P (S6) of the sixth reflective surface S6 may be in the range of 15.5 to 17.5 degrees, the angle P (S7) of the seventh reflective surface S7 may be in the range of 8.5 to 11 degrees, the angle P (S8) of the eighth reflective surface S8 may be in the range of 2 to 4 degrees, and the angle P (S9) of the ninth reflective surface S9 may be in the range of 5 to 9 degrees. The fifth to ninth reflective surfaces S5, S6, S7, S8 and S9 are disposed in a parabola shape in a region between the LED 173 and the light-transmissive sheet 180, and reflect the incident light to the second reflective sheet 165 and the light-transmissive sheet 180, and thus the light-transmissive sheet 180 may be uniformly radiated to suppress generation of a bright line due to the light directly radiated. The tenth reflective surface S10 may be disposed in a region that does not affect light distribution.

Meanwhile, when viewing the angle distribution of each reflective sheet starting from the LED in FIG. 9, the angles A1 and A2 may be the half angle of the orientation angle with respect to the optical axis X0 of the light emitting diode, the angle A3 may be an angle P with respect to opposite ends of the second reflective sheet 165, and the angle A4 may be an angle P with respect to opposite ends of the light-transmissive sheet 180. The angles A1 and A2 range from 62 to 65 degrees, the angle A3 ranges from 22 to 26 degrees, and the angle A4 ranges from 33 to 36 degrees. Here, the orientation angle may be 115 degrees or more, for example, 118 degrees or more, and the half angle of the orientation angle may be 57.5 or more, for example, 58 degrees or more.

Figure 10:
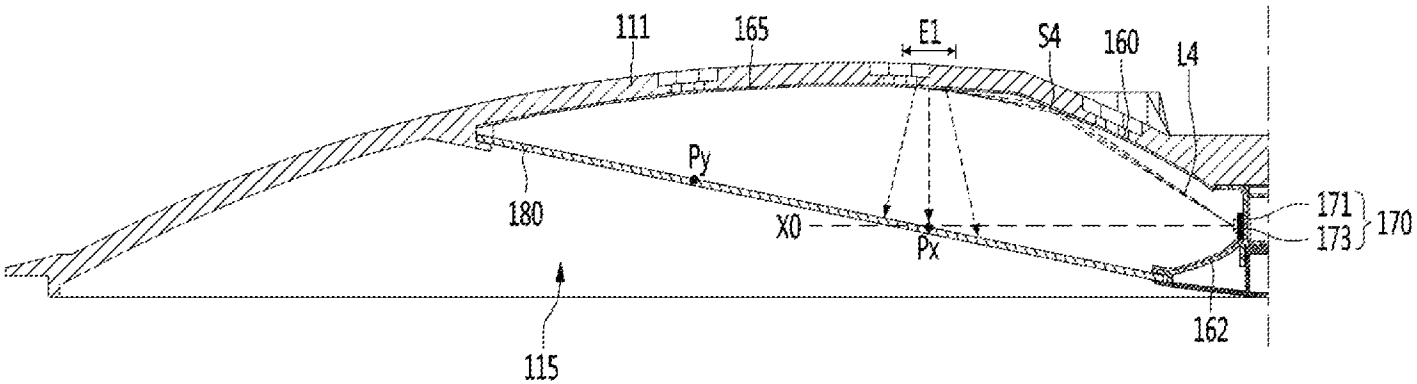
FIGS. 10 to 13 are views illustrating paths of light reflected from the first reflective sheet of FIG. 7.

As shown in FIG. 10, the fourth reflective surface S4 of the first reflective sheet 160 reflects light incident from the LED 173 to a first region E1 of the second reflective sheet 165, and light incident on the first region E1 may be reflected irregularly and radiated to a first point Px of the light-transmissive sheet 180 and a peripheral region thereof, for example, a center lower portion region. The first region E1 may be a region adjacent to the first reflective sheet 160, and may be a region of 0 to 25% from an interface with the first reflective sheet 160 in the region of the second reflective sheet 165.

Figure 11:
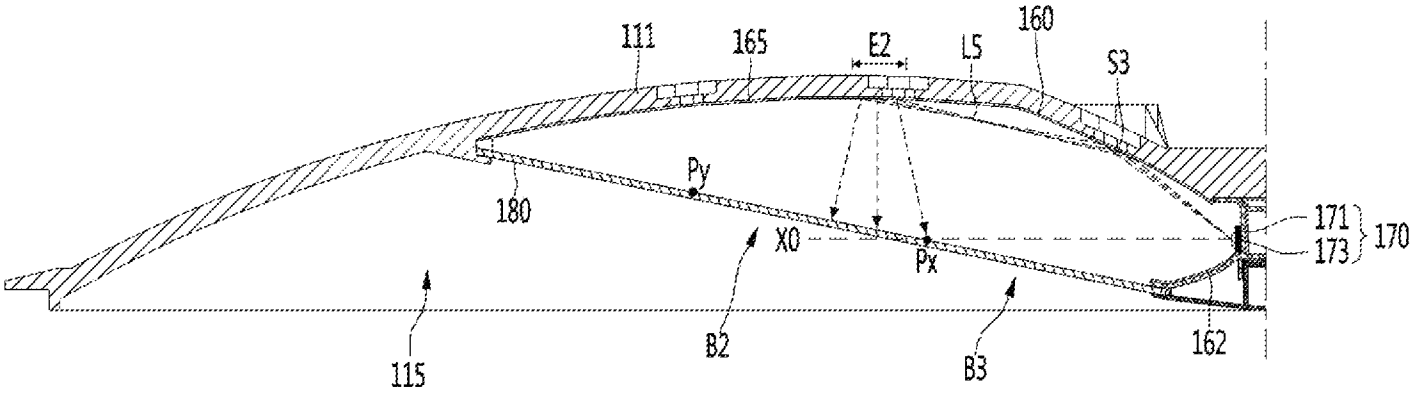

As shown in FIG. 11, the third reflective surface S3 of the first reflective sheet 160 reflects the light incident from the LED 173 to a second region E2 of the second reflective sheet 165, and the light incident on the second region E2 may be reflected irregularly and radiated to a center of the light-transmissive sheet 180 and a peripheral region thereof. The second region E2 may be a region ranging from 25 to 40% from the interface with the first reflective sheet 160.

Figure 12:
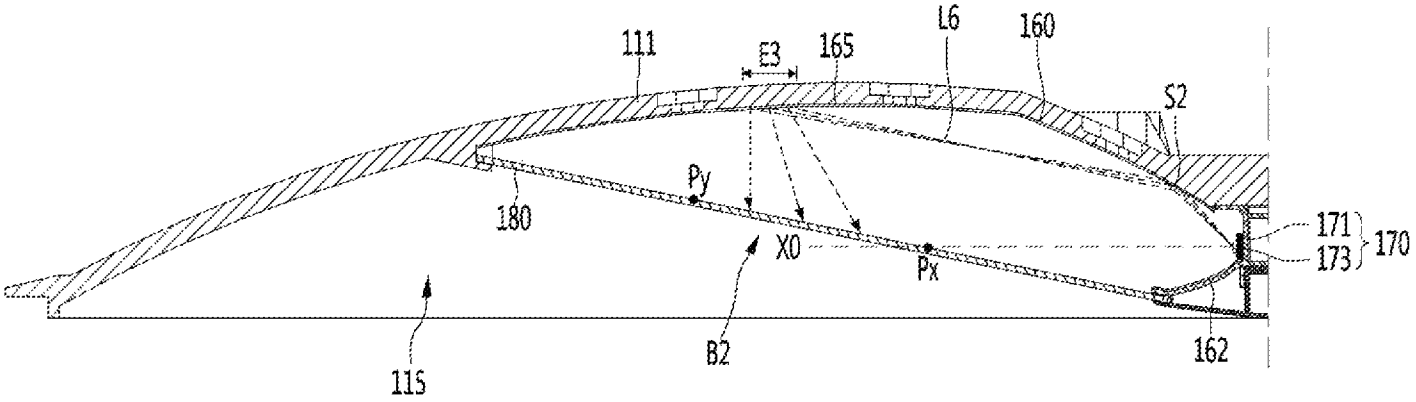

As shown in FIG. 12, the second reflective surface S2 of the first reflective sheet 160 reflects the light incident from the LED 173 to a third region E3 of the second reflective sheet 165, the light incident on the third region E3 may be reflected irregularly and radiated to the center and the peripheral region B2 of the light-transmissive sheet 180. The third region E3 may be a region ranging from 40% to 55% from the interface with the first reflective sheet 160.

Figure 13:
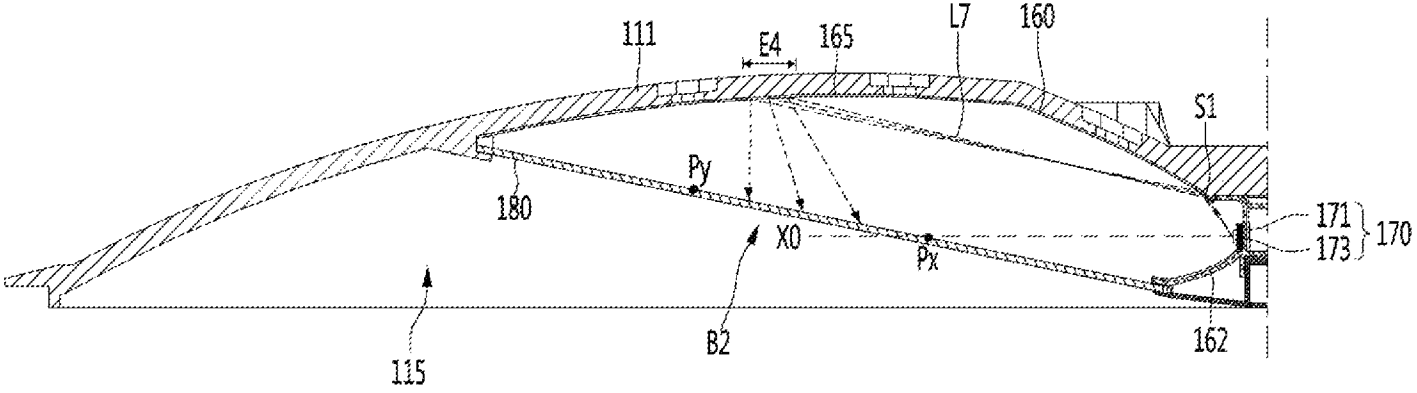

As shown in FIG. 13, the first reflective surface S1 of the first reflective sheet 160 reflects the light incident from the LED 173 to a fourth region E4 of the second reflective sheet 165, and the light incident on the fourth region E4 may be reflected irregularly and radiated to the center and the peripheral region B2 of the light-transmissive sheet 180. The fourth region E4 may be a region ranging from 40 to 55% from the interface with the first reflective sheet 160. Here, the first and second reflective surfaces S1 and S2 of the first reflective sheet 160 reflect specularly the incident light and radiates in a range of 40 to 55% from a specific region of the second reflective sheet 165, for example, a boundary with the first reflective sheet 160, and radiates to a center region B2 of the light-transmissive sheet 180. Accordingly, the bright line by the main light directly radiated from the LED 173 in the center region B2 of the light-transmissive sheet 180 may be reduced by the indirectly incident light.

Figure 14:
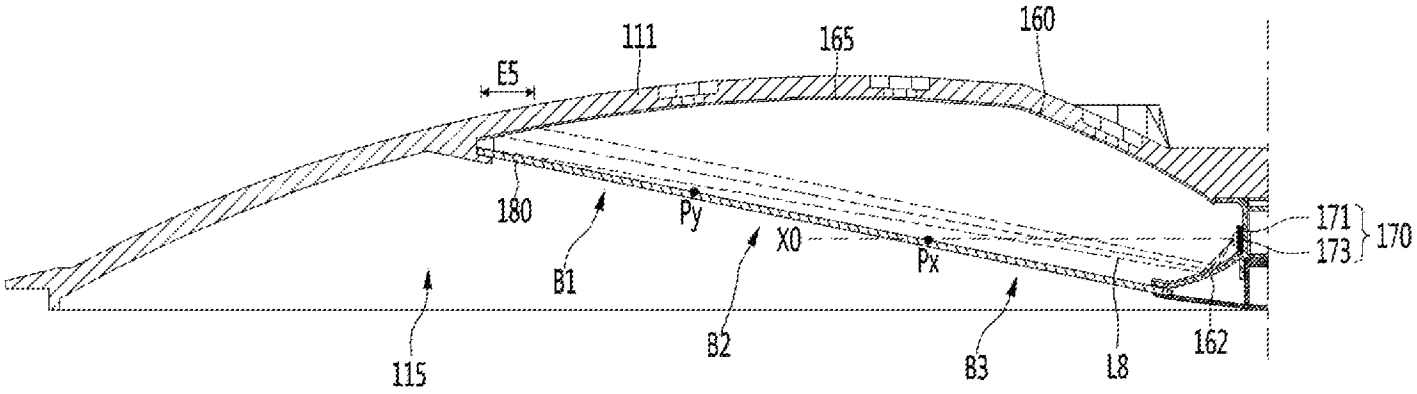
FIGS. 14 to 16 are views illustrating paths of light reflected from the third reflective sheet of FIG. 7.

Referring to FIG. 14, the fifth reflective surface S5 of the third reflective sheet 162 reflects the light incident from the LED 173 to the fifth region E5 of the second reflective sheet 165, and the light incident on the fifth region E5 is reflected irregularly and radiated to an upper portion edge region B1 of the light-transmissive sheet 180 adjacent to the second reflective sheet 165. The fifth region E5 may be a region ranging from 85 to 100% from the interface with the first reflective sheet 160.

Figure 15:
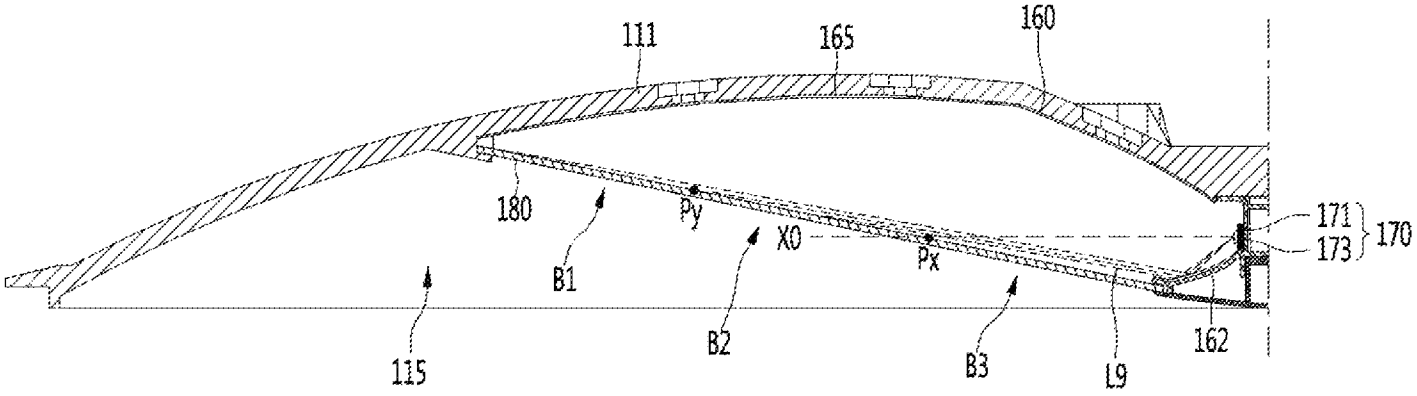

Referring to FIG. 15, the sixth reflective surface S6 of the third reflective sheet 162 reflects the light incident from the LED 173 to upper portion regions B1 and B2 of the light-transmissive sheet 180. The upper portion region of the light-transmissive sheet 180 may range from 50 to 100% from a lower end of the light-transmissive sheet 180.

Figure 16:
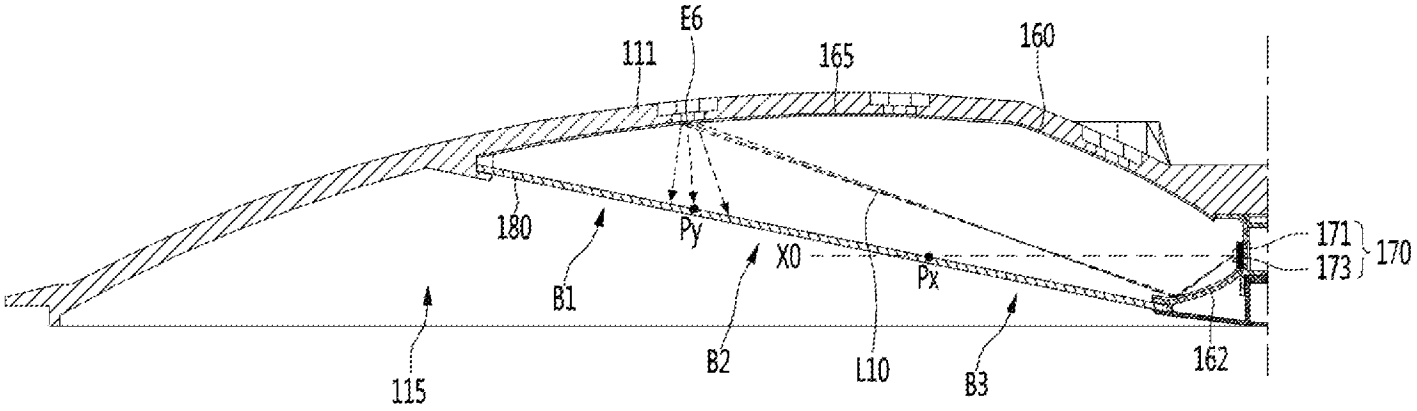

Referring to FIG. 16, the seventh reflective surface S7 of the third reflective sheet 162 reflects the light incident from the LED 173 to the sixth region E6 of the second reflective sheet 165, and the light reflected irregularly from the sixth region E6 may be radiated in a range of 30 to 40% of the light-transmissive sheet 180.

According to an embodiment, the second reflective sheet 165 reflects irregularly the light incident from the first reflective sheet 160 and the LED 173 and uniformly irradiates the center region B2 of the light-transmissive sheet 180, and thus it is possible to suppress the generation of a bright line due to the light directly incident on the light-transmissive sheet 180 from the LED 173. The light reflected by the third reflective sheet 162 is reflected irregularly by the second reflective sheet 165 or radiated onto the upper portion regions B1 and B2 of the light-transmissive sheet 180, and thus it is possible to eliminate a bright line caused by light directly incident on the light-transmissive sheet 180 from the LED 173.

The first to third reflective sheets 160, 165 and 162 improve uniformity of distribution of the light directly radiated to the light-transmissive sheet 180 by the LED 173, thereby eliminating a bright line of a light incident portion. It can be seen from the light flux distribution of the light-transmissive sheet of the lighting apparatus that the bright line is eliminated. Here, a size of the lighting apparatus is 550 to 600 mm×550 to 600 mm, and a thickness or height ranges from 50 to 52 mm. The orientation angle of the LED may also be in the range of 120 degrees+/−5%.

When viewing the Unified Glare Rating (UGR) of the lighting apparatus of the present invention, the UGR is 19 or less, indicating that the user may not have uncomfortable glare. In the CIE regulations, it is classified that a user has a discomfort glare when the UGR is 21 or more.

Table 1 illustrates UGR, light efficiency, and light uniformity of the lighting apparatus according to an embodiment.

TABLE 1

| UGR | | | |
|---|---|---|---|
| Endwise (horizontal) | Crosswise (vertical) | Light Efficiency | Uniformity |
| 18.2 | 19.0 | 85.1% | 82.2% |

<Light Emitting Device Package>

Figure 17:
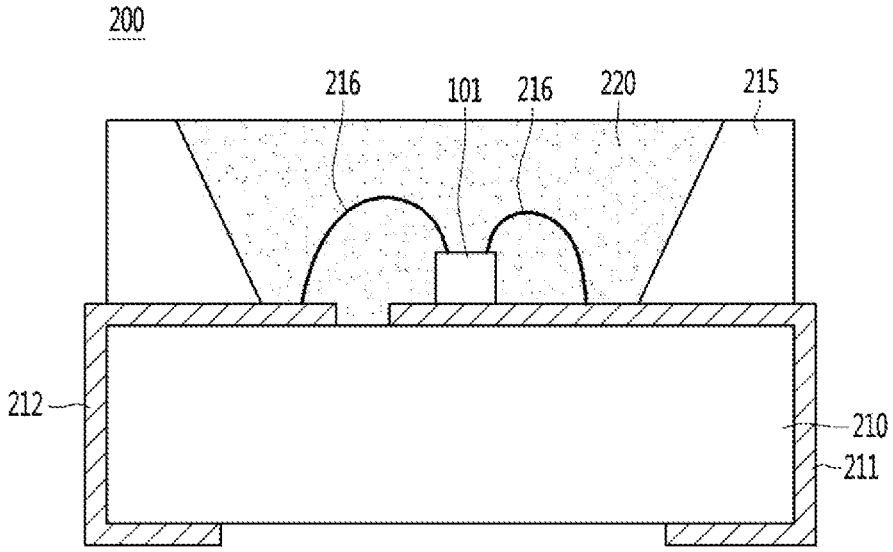
FIG. 17 is a side cross-sectional view illustrating a light emitting diode according to an embodiment.

FIG. 17 is a sectional view showing a light emitting diode according to the embodiment.

Referring to FIG. 17, the light emitting diode 200 includes a body 210; first and second lead electrodes 211 and 213, at least portions of which are disposed in the body 210, a light-emitting device 101 electrically connected to the first and second lead electrodes 211 and 212 on the body 210, and a molding member 220 surrounding the light emitting device 101.

The body 210 may be formed of at least one of a silicon material, a synthetic resin material and a metallic material. The body 210 may include a cavity formed therein and a reflective portion 215 having an inclined surface at the periphery thereof.

The first lead electrode 211 and the second lead electrode 213 are electrically separated from each other, and are formed to pass through the body 210. That is, the inner side portions of the first and second lead electrodes 211 and 212 may be disposed in the cavity and the other portions of the first and second lead electrodes 211 and 212 may be disposed at an outside of the body 210.

The first lead electrode 211 and the second lead electrode 212 provide power to the light-emitting device 100. Also, the first lead electrode 211 and the second lead electrode 213 reflect the light emitted from the light emitting device 101, thus improving the light emitting efficiency. Also, the first lead electrode 211 and the second lead electrode 213 may serve to discharge the heat generated from the light emitting device 101.

The light emitting device 101 may be disposed on the body 210, or may be formed on the first lead electrode 211 and/or the second lead electrode 212. The light emitting device 101 may be arranged as at least one LED (Light Emitting Diode) chip. The LED chip may include a light emitting diode in a visible light band such as red, green, blue or white, or a UV light emitting diode that emits ultraviolet (UV) light. A phosphor layer may be further disposed on the surface of the light emitting device 101, but the present invention is not limited thereto.

The wire 216 of the light emitting device 101 may be electrically connected to at least one of the first and second lead electrodes 211 and 212, but the embodiment is not limited thereto.

The molding member 220 may surround the light-emitting device 101 to protect the light emitting device 101. Also, the molding member 220 may include a fluorescent material to change the wavelength of light emitted from the light emitting device 101. The upper surface of the molding member 220 may be flat, concave or convex. The upper surface of the molding member 220 or the cavity region may be the light emitting surface according to the embodiment, but the present invention is not limited thereto.

A lens may be disposed on the molding member 220, but the present invention is not limited thereto.

The light emitting diode 200 may be a blue light emitting device or a white light emitting device having a high color rendering index (CRI). The light emitting diode may be a light emitting device that emits white light by molding a synthetic resin containing a phosphor on a blue light emitting chip. The phosphor may include at least one of a garnet (YAG, TAG), a silicate, a nitride, and an oxy-nitride.

The features, structures, effects and the like described in the embodiments are included in at least one embodiment of the present invention, and are not necessarily limited to only one embodiment. Furthermore, the features, structures, effects and the like illustrated in the embodiments can be combined and modified by other persons skilled in the art to which the embodiments belong. Therefore, it is to be understood that the present invention is not limited to these embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

An embodiment may be applied to a flat panel lighting apparatus.

An embodiment may be applied to a lighting apparatus for a flat panel having a light emitting diode.

The invention claimed is:

1. A lighting apparatus, comprising:

a housing having a first back cover including a recess at lower portion and a reflective surface of a parabolic shape;

a first light emitting module disposed on a first corner of the recess of the back cover and having a plurality of light emitting diodes (LEDs) arranged in a first direction;

a heat dissipation body in which the first light emitting module is disposed, the heat dissipation body having a heat dissipation portion; and a light-transmissive sheet disposed in an oblique direction at a recess of the housing and transmitting light emitted from the LEDs, wherein the reflective surface includes a first reflection region adjacent to the LEDs and a second reflection region disposed between an upper portion of the light-transmissive sheet and the first reflection region, wherein the first reflection region reflects light incident from the LEDs to a different region of the second reflection region, wherein the second reflection region reflects irregular light incident from the first reflection region to a center region of the light-transmissive sheet, wherein the light-transmissive sheet has a first end and a second end, and includes a lower region which is disposed at a lower position than a horizontal straight line with respect to the plurality of LEDs and the upper region which is disposed at a higher position than the horizontal straight line, wherein the first end of the light-transmissive sheet is in the lower region, and the second end of the light-transmissive sheet is in the upper region; and wherein the heat dissipation body includes a third reflection region disposed between the LEDs and a lower end portion of the light-transmissive sheet, a first end of the third reflection region is to couple to the first end of the light-transmissive sheet, and a second end of the third reflection region is to couple to the heat dissipation portion, wherein the third reflection region has a concave curved surface between the first end and the second end, and the third reflection region reflects specularly the incident light to the light-transmissive sheet and the second reflection region.

2. The lighting apparatus of claim 1, wherein the first reflection region and the third reflection region include a metal material and the second reflection region includes a non-metallic material.

3. The lighting apparatus of claim 1, wherein the heat dissipation body is disposed on the first corner of the recess.

4. A lighting apparatus, comprising:

a housing including first and second back covers disposed on opposite sides of a center and each having an inside surface in a parabola shape;

an recess opened at lower portions of the first and second back covers;

a first light-transmissive sheet disposed in an oblique direction in a recess of the first back cover;

a second light-transmissive sheet disposed in an oblique direction in a recess of the second back cover;

a first light emitting module having a plurality of LEDs arranged in a first direction at a first corner of the recess of the first back cover;

a second light emitting module having a plurality of LEDs arranged in the first direction at a second corner of the recess of the second back cover;

a heat dissipation body in which the first and second light emitting modules are disposed in a region between the recess of the first back cover and the recess of the second back cover; and a first reflective sheet disposed adjacent to the LEDs in the inside surfaces of the first and second back covers, and reflecting first side light emitted from the plurality of LEDs, wherein the heat dissipation body includes a first heat dissipation portion in which the first light emitting module is disposed, a second heat dissipation portion in which the second light emitting module is disposed, a first reflecting portion disposed between the first heat dissipation portion and a lower end of the first light-transmissive sheet, and a second reflecting portion disposed between the second heat dissipation portion and a lower end of the second light-transmissive sheet, wherein the first reflective sheet has a plurality of reflective surfaces, wherein the first light-transmissive sheet includes a lower region which is disposed at a lower position than a first horizontal straight line with respect to the LEDs of the first light emitting module and an upper region which is disposed at a higher position than the first horizontal straight line, wherein a first end of the first light-transmissive sheet is in the lower region, and a second end of the first light-transmissive sheet is in the upper region, and wherein the second light-transmissive sheet includes a lower region which is disposed at a lower position than a second horizontal straight line with respect to the LEDs of the second light emitting module and an upper region which is disposed at a higher position than the second horizontal straight line, wherein a first end of the second light-transmissive sheet is in the lower region, and a second end of the second light-transmissive sheet is in the upper region, and wherein a first end of the first reflecting portion is to couple to the first end of the first light-transmissive sheet and a second end of the first reflecting portion is to couple to the first heat dissipation portion, wherein the first reflecting portion has a concave curved surface between the first end and the second end; and wherein a first end of the second reflecting portion is to couple to the first end of the second light-transmissive sheet and a second end of the second reflecting portion is to couple to the second heat dissipation portion, wherein the second reflecting portion has a concave curved surface between the first end and the second end.

5. The lighting apparatus of claim 4, wherein the first and second back covers have a shape linearly symmetrical with respect to a centerline, forms the inside surfaces of the first and second back covers into a convex curved surface, and includes a second reflective sheet disposed on the inside surfaces of the first and second back covers, wherein the second reflective sheet is disposed between the first reflective sheet and an upper end portion of the first and second light-transmissive sheets, respectively, and the second reflective sheet reflects the light reflected from the plurality of LEDs and the first reflective sheet to the first and second light-transmissive sheets.

6. The lighting apparatus of claim 5, wherein the first and second reflecting portions of the heat dissipation body include a third reflective sheet having a large number of reflective surfaces having different radii of curvature than the surfaces of the first and second reflecting portions.

7. The lighting apparatus of claim 6, wherein the third reflective sheet reflects specularly the light incident from the plurality of LEDs to an upper region of the second reflective sheet and an upper region of the first and second light-transmissive sheets.

8. The lighting apparatus of claim 4, wherein the first and second light-transmissive sheets include a diffusion sheet.

9. The lighting apparatus of claim 5, wherein the first reflective sheet includes a specular reflection material, and wherein the first and second light-transmissive sheets includes a diffusion sheet.

10. The lighting apparatus of claim 9, wherein the second reflective sheet includes a scattered reflection material.

11. The lighting apparatus of claim 4, wherein the reflective surfaces of the first reflective sheet have different radii of curvature, and radii of curvature of the reflective surfaces of the first reflective sheet gradually increase as getting far away from a center of a top surface of the LEDs.

12. The lighting apparatus of claim 6, wherein a radius of curvature of the reflective surface of the third reflective sheet gradually increases as getting farther away from a center of a top surface of the LEDs.

13. The lighting apparatus of claim 6, wherein the third reflective sheet is disposed closer to the LEDs than the first reflective sheet.

14. The lighting apparatus of claim 4, wherein the first and second light emitting modules include a circuit board on which the LEDs are disposed, the circuit board of the first and second light emitting modules is disposed on the first and second heat dissipation portions, the first and second heat dissipation portions have a perpendicular surface, and the circuit board of the first and second light emitting modules is disposed in parallel, and wherein the first and second dissipation portions are disposed on opposite sides of the center of the housing.

15. The lighting apparatus of claim 4, comprising:

a heat dissipation cover disposed below the heat dissipation body, wherein the heat dissipation cover includes a lower portion plate disposed under lower end portions of the first and second light-transmissive sheets.

16. The lighting apparatus of claim 15, wherein the lower portion plate of the heat dissipation cover is disposed and inclined from a lower portion center of the heat dissipation cover.

17. The lighting apparatus of claim 16, wherein the lower end portions of the first and second light-transmissive sheets are disposed between the first and second reflecting portions of the heat dissipation body and the lower portion plate of the heat dissipation cover.

18. The lighting apparatus of claim 16, wherein an LED of the plurality of LEDs includes a body having a cavity, a light emitting chip disposed in the cavity of the body, and a molding member having a phosphor disposed in the cavity, and an angle formed by the first and second light-transmissive sheets with respect to an optical axis of the LED is 13 degrees or less.

* * * * *